United States Patent [19]

Armstrong et al.

[11] 3,962,971

[45] June 15, 1976

[54] GANG-TYPE PRICE MARKER

[76] Inventors: Ralph L. J. Armstrong, 2202 Monticello Place, Springdale, Ark. 72764; Jeffrey M. Stockton, 41 Eastwood Drive, Hutchinson, Kans. 67501

[22] Filed: Oct. 3, 1974

[21] Appl. No.: 511,701

[52] U.S. Cl. ..... 101/42; 101/110

[51] Int. Cl.[2] ..... B41J 1/32

[58] Field of Search ..... 101/110, 108, 101, 97, 101/41, 44, 42, 43, 103, 106, 95, 99; 53/131

[56] References Cited

UNITED STATES PATENTS

| | | | |
|---|---|---|---|
| 1,713,528 | 5/1929 | Glass | 101/110 |
| 1,949,693 | 3/1934 | Phillips | 101/110 |
| 2,067,637 | 1/1937 | Hoffman | 101/110 X |
| 2,551,092 | 5/1951 | Bryant | 101/42 |
| 2,951,574 | 9/1960 | Craig | 198/30 |
| 3,024,724 | 3/1962 | Angus | 101/110 |
| 3,101,047 | 8/1963 | Weissman | 101/103 |
| 3,241,482 | 3/1966 | Keck | 101/103 |
| 3,266,417 | 8/1966 | Evers | 101/41 |
| 3,296,959 | 1/1967 | Sewell | 101/110 UX |
| 3,756,148 | 9/1973 | Nakata | 101/110 X |
| 3,777,445 | 12/1973 | Anderson | 53/131 X |

*Primary Examiner*—Edgar S. Burr
*Assistant Examiner*—Edward M. Coven
*Attorney, Agent, or Firm*—Clarence A. O'Brien; Harvey B. Jacobson

[57] ABSTRACT

A price marker for simultaneously price stamping all containers in a case or carton of containers is provided. The marker includes a frame having four sets of price stamp assemblies supported therefrom and each set of assemblies includes at least three assemblies spaced apart in a row. The sets of assemblies are supported from the frame with the rows thereof disposed in generally parallel side-by-side relation and each price stamp assembly includes a plurality of price stamp wheels supported for independent angular adjustment to bring selected portions of the wheels into price stamping position. At least one set of the price stamp assemblies is stationarily supported from the frame and at least two sets of the price stamping assemblies are supported from the frame for adjustable shifting relative to the latter for varying the spacing between at least two pairs of adjacent sets of assemblies. An actuator is shiftably supported from the frame and operatively connected to the adjustably shiftable sets of price stamp assemblies and a plurality of price adjustment operators are shiftably supported from the frame. The number of price adjustment operators is equal to the number of price stamp wheels of each assembly and the operators are each drivingly connected to the corresponding price stamp wheels of all of the price stamp assemblies in a manner such that shifting of each operator will simultaneously adjust all of the corresponding price stamping wheels. Further, the operators are drivingly connected to their respective price stamping wheels of the stationary price stamp assemblies as well as adjustable price stamp assemblies throughout their ranges of adjustment. The adjustably shiftable sets of price stamp assemblies are provided in order to enable the price marker to be utilized in simultaneously price marking all containers within a case or carton of containers, even though the spcing between the central areas of adjacent containers in different cartons may vary due to the containers in the cartons being of different size.

5 Claims, 14 Drawing Figures

GANG-TYPE PRICE MARKER

BACKGROUND OF THE INVENTION

The price marker of the instant invention has been designed to enable simultaneous price marking of all containers within a case or carton of containers.

Conventionally, containers to be price marked are individually marked by means of a price stamp which is adjustable to stamp the desired price marking. When a plurality of containers shipped within a carton are to be price stamped before being placed on display in a retail store, the top of the case or carton is removed to expose the upper ends of the containers packaged within the carton. Then, the price marker to be used is adjusted to stamp the desired price marking and the price marker is individually stamped on the top of each container.

It is customary for containers within a case or carton to be placed in four rows of containers with each row of containers including three containers. In this manner, a dozen containers are exposed when the top of a case or carton is removed prior to price marking of the containers. While some cartons may include only a single layer of containers, other cartons may contain as many as two, three or four layers of containers with each layer including twelve containers.

If a carton contains two layers of twelve containers each of the carton may be cut in a horizontal plane about the vertical center of the carton and the upper half thereof may be removed from about the containers in the upper layer within the carton. Then, the top layer of containers is price marked and placed on display leaving the bottom layer of containers exposed for price marking.

Bearing in mind that there are usually twelve containers in each layer packaged within a case or carton of containers, it may then be seen that it would be possible to construct a price marker including twelve price stamp assemblies arranged in four rows of three price stamp assemblies each. Then, structure could be provided for simultaneously adjusting corresponding stamp wheels or belts of the twelve price stamp assemblies and after all of the price stamp assemblies have been properly adjusted all twelve containers in a layer of containers within a case or carton could be simultaneously price stamped. However, various different sizes of containers such as boxes or cans of foodstuffs are packaged in cartons including twelve containers in a layer. Thus, the spacing between the central portions of the upper ends of twelve small containers in a small carton is appreciably less than the spacing between twelve large containers in a larger carton. Accordingly, inasmuch as there are various size cartons of containers of foodstuffs shipped to food stores and the like, a food store would have to be provided with various different sizes of gang-type price markers with one size gang-type price marker being provided for each size carton having twelve containers in each layer of containers. Therefore, the concept of gang-type price markers has heretofore not been adaptable to usage in food stores and the like which have cases or cartons of different size containers to be price marked.

Examples of price stamping devices including individual price stamp assemblies and gang-type price markers heretofore patented may be found in U.S. Pat. Nos. 1,132,519, 2,551,092, 2,703,017, 2,946,279, 3,101,047, 3,166,243, 3,241,482, 3,309,987 and 3,630,143.

The gang-type price marker of the instant invention has been constructed to provide a means whereby all of the containers in a layer of containers within a case or carton may be price stamped at one time. The price marker is constructed in a manner whereby the spacing between rows of price stamp assemblies thereof may be adjusted in order to adjust the price marker for stamping all of the containers in a layer of containers within cartons of different sizes. Further, the price marker includes novel structure whereby the stamp wheels of each price stamp assembly may be readily adjusted.

The main object of this invention is to provide a gang-type price marker constructed in a manner whereby the spacing between selected price stamp assemblies thereof may be varied in order to adapt the gang-type marker for simultaneously marking all containers in a layer of containers within cases of different sizes.

Another object of this invention is to provide a gang-type price marker including means by which the price stamping wheels of each price stamping assembly may be adjusted as desired from a single adjustment control station including an operator for each set of corresponding price stamping wheels of the price stamping assemblies.

A still further object of this invention is to provide a gang-type price marker constructed in a manner whereby the price stamping assemblies thereof may have the spacing therebetween adjusted as desired and with the gang-type price marker including a single operator for adjusting the spacing of the adjustable price stamp assemblies.

A final object of this invention to be specifically enumerated herein is to provide a gang-type price marker in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
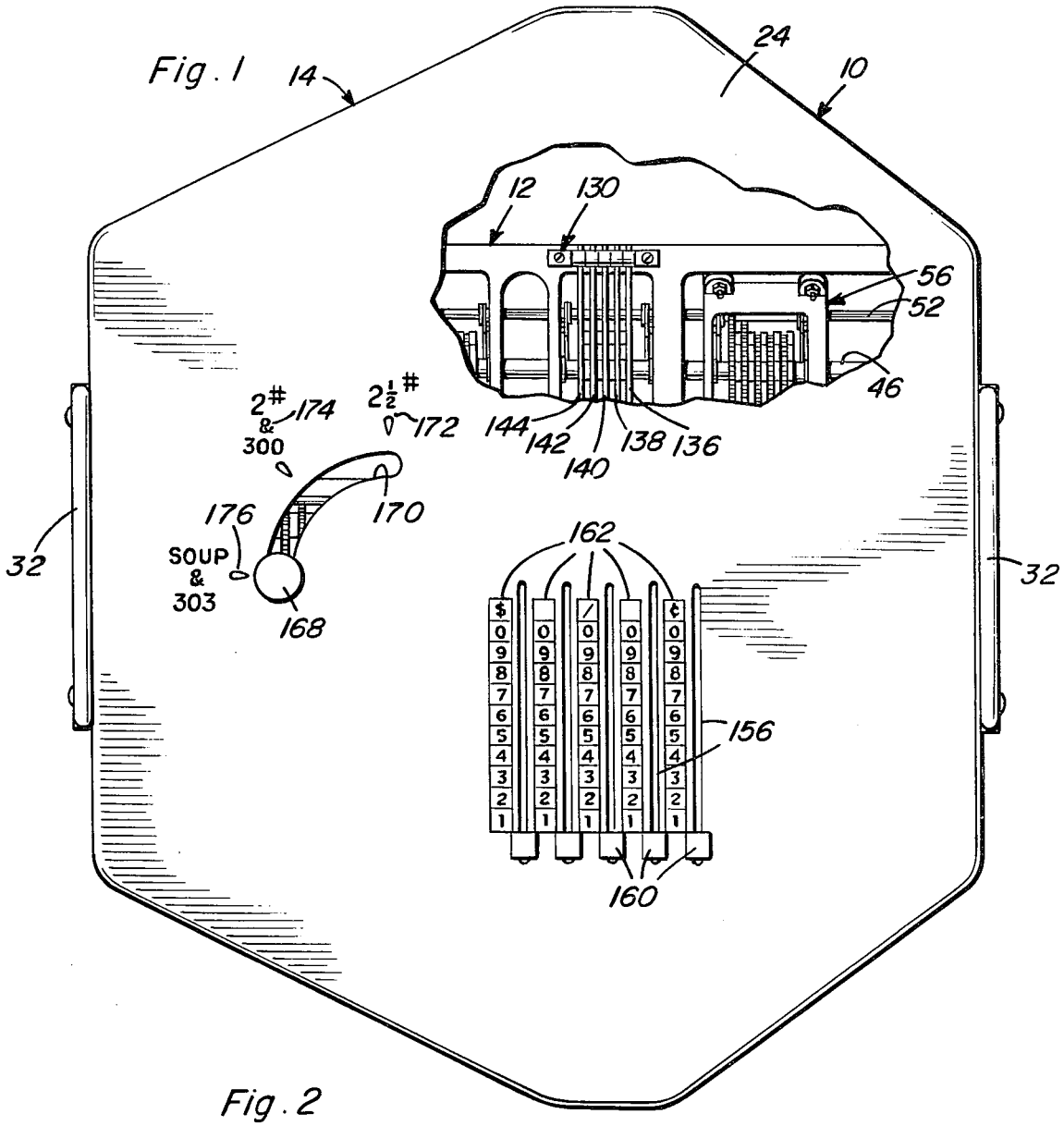
FIG. 1 is a top plan view of the gang-type price marker of the instant invention with a portion of the top wall thereof being broken away.

Referring now more specifically to the drawings the numeral 10 generally designates the price marker of the instant invention. The marker 10 includes a cast main frame referred to in general by the reference numeral 12 and a downwardly opening cover referred to in general by the reference numeral 14 including remote opposite side walls 16 and 18 as well as outwardly bowed front and rear walls 20 and 22. The cover 14 also includes a top wall 24 secured to and extending between the upper marginal edge portions of the side walls 16 and 18 and the front and rear walls 20 and 22. The side walls 16 and 18 are secured over the outer surfaces of opposite side members 26 and 28 of the frame 12 by means of fasteners 30 secured through the side walls 16 and 18 and in the side members 26 and 28 of the frame 12. In addition, the cover 14 includes a pair of opposite side downwardly opening inverted U-shaped handles 32 having the lower ends of the depending legs 34 thereof secured over the outer surfaces of the side walls 16 and 18 by means of suitable fasteners 36.

The main frame 12 includes front and rear members 38 and 40 extending and secured between the front and rear ends, respectively, of the side members 26 and 28 as well as additional central interconnected transverse and longitudinal members.

Figure 4:
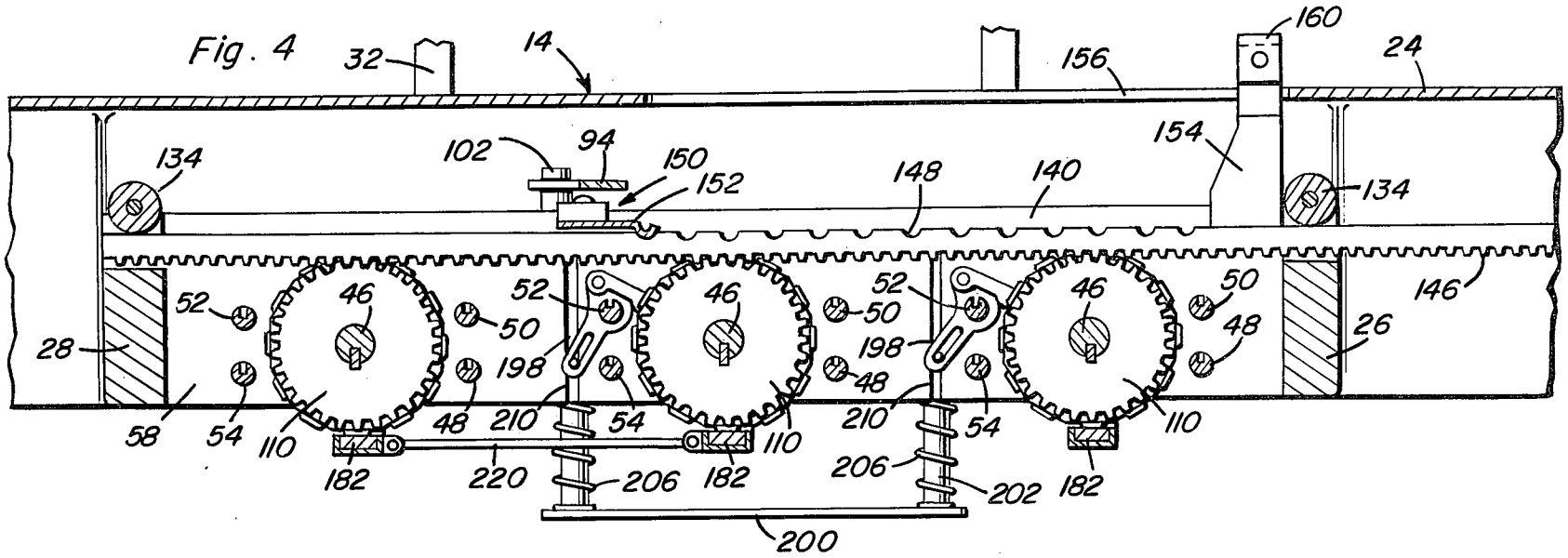
FIG. 4 is a fragmentary vertical sectional view taken substantially upon the plane indicated by the section line 4—4 of FIG. 3.
Figure 5:
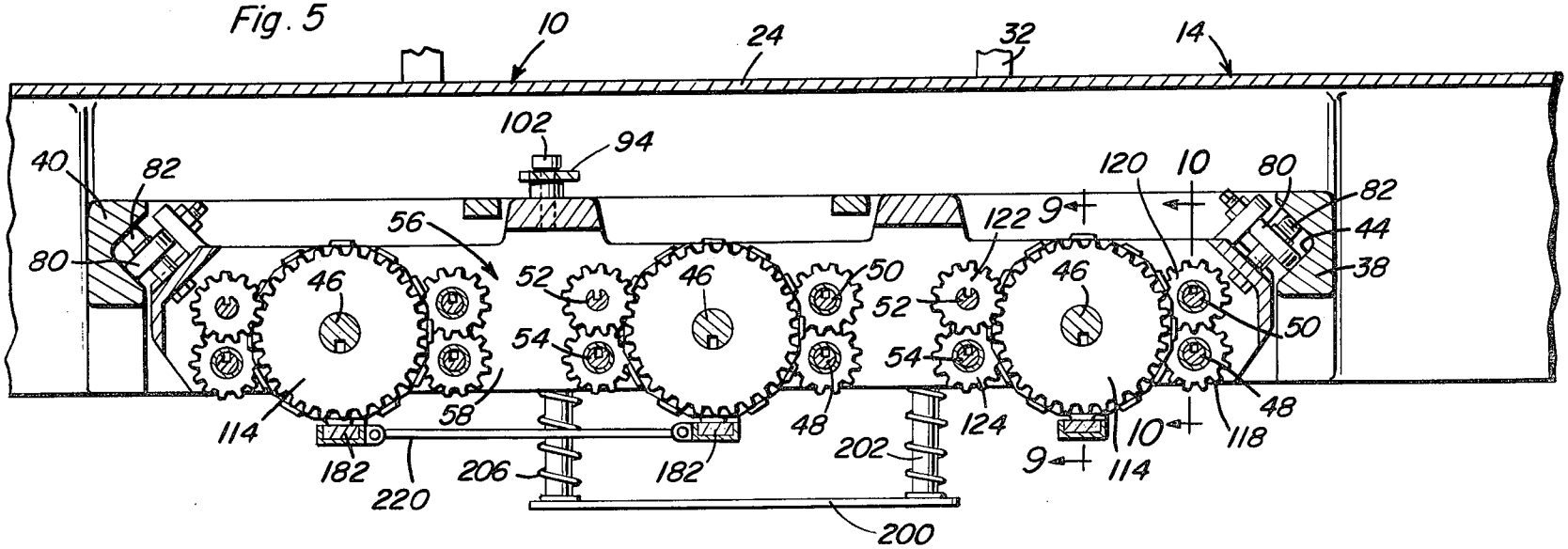
FIG. 5 is a fragmentary enlarged vertical sectional view taken substantially upon the plane indicated by the section line 5—5 of FIG. 3.

The opposite ends of the front and rear members 38 and 40 are provided with horizontally inwardly opening V-shaped grooves 44 defining guide tracks to be hereinafter more fully explained and three transverse main support shafts 46 extend between and are journaled from the side members 26 and 28. Further, with attention now invited more specifically to FIGS. 4 and 5 of the drawings, each support shaft 46 has four secondary shafts 48, 50, 52 and 54 equally spaced therefrom and spaced thereabout, the opposite ends of the shafts 48, 50, 52 and 54 being journaled from the corresponding side members 26 and 28.

Each of the shafts 46, 48, 50, 52 and 54 is provided with a longitudinal keyway.

A pair of trolley frames referred to in general by the reference numerals 56 are slidably mounted on the shafts 46, 48, 50, 52 and 54 adjacent the side members 26 and 28. The trolley frames 56 include outer and inner side members 58 and 60 and the side members 58 and 60 include a pair of aligned bores 62 and 64 for each shaft 48, 50, 52 and 54. Pairs of different lengths axially aligned spacing sleeves 66 and 68 are provided for each pair of aligned bores 62 and 64 and have their remote ends telescoped into the latter bores. The corresponding shafts 48, 50, 52 and 54 are rotatably received through the spacer sleeves 66 and 68 and a pair of spacer sleeves 70 and 72 are partially telescoped into pairs of aligned bores 74 and 75 formed in the side members 58 and 60 for each shaft 46. The sleeves 66, 68, 70 and 72 are shouldered for bearing against the opposing sides of the corresponding side members 58 and 60 and each of the shafts 46 is rotatably received through the corresponding sleeves 70 and 72.

The longitudinal members of the main frame 12 extending between the front and rear members 38 and 40 and disposed inwardly of the side members 26 and 28 include pairs of outer and inner longitudinal members 78 and 76 corresponding to the outer and inner side members 58 and 60 of the trolley frames 56 and which are also provided with spacing sleeves corresponding to the sleeves 66, 68, 70 and 72 through which the shafts 48, 50, 52, 54 and 46 are rotatably received.

In addition to being supported from the shafts 46, 48, 50, 52, and 54, the trolley frames 56 include sets of opposite end relatively rightangularly disposed rollers 80 and 82 journaled therefrom rollingly seated in the corresponding V-shaped grooves 44.

Figure 3:
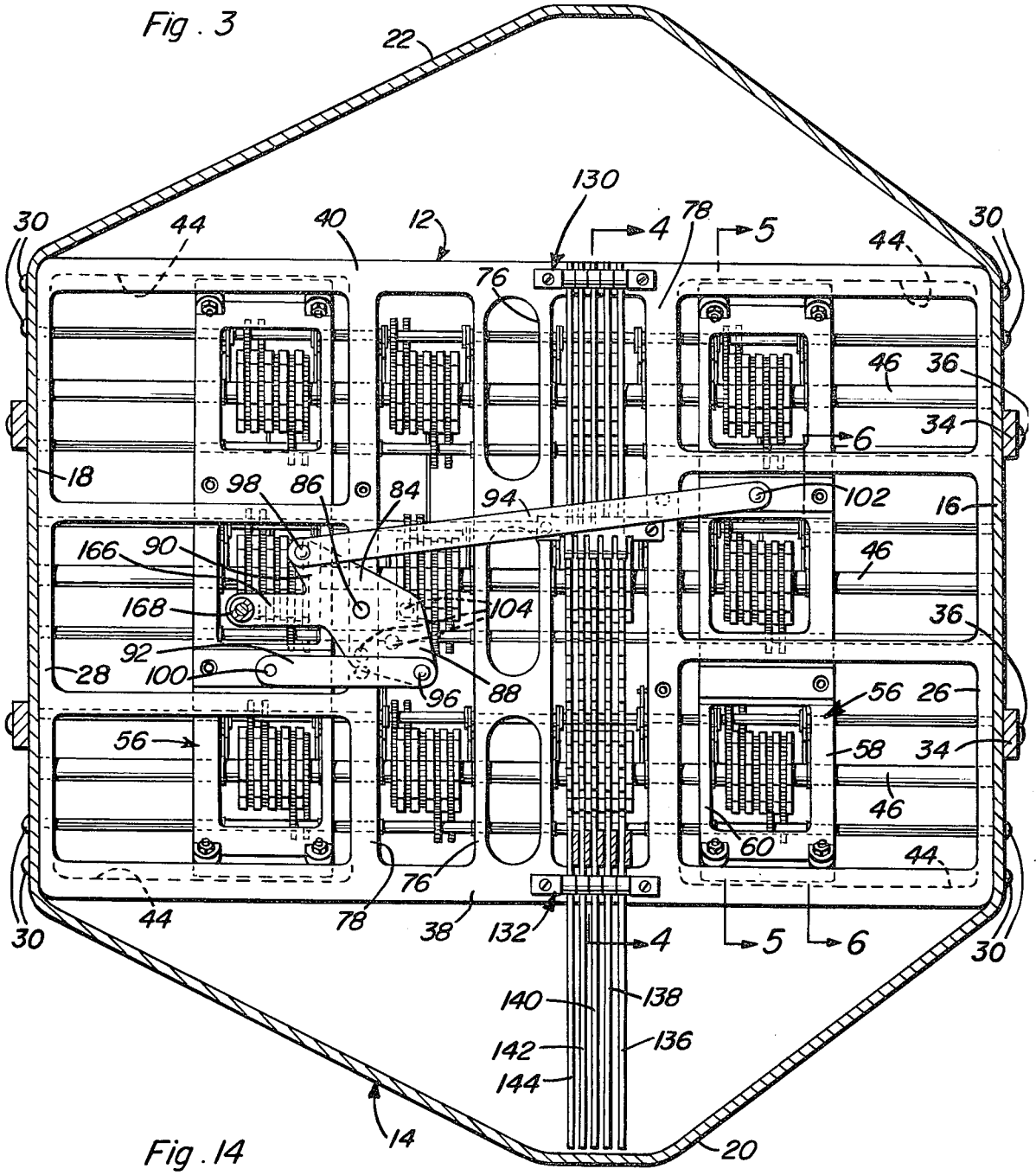
FIG. 3 is a horizontal sectional view taken substantially upon the plane indicated by the section line 3—3 of FIG. 2 and on somewhat of an enlarged scale.

With attention now invited more specifically to FIG. 3 of the drawings, an actuating lever 84 is pivotally supported by means of a pivot fastener 86 from the central portion of the left hand longitudinal member 78 of the frame 12. The lever includes opposite end portions 88 and 90 to which connecting links 92 and 94 are pivotally attached by means of fasteners 96 and 98 and the remote ends of the connecting links 92 and 94 are pivotally attached to the trolley frames 56 by means of pivot fasteners 100 and 102. In addition, the longitudinal member 78 to which the lever 84 is pivotally secured includes a spring-biased detent (not shown) seatable in downwardly opening recesses 104 formed in the underside of the lever 84 and disposed in an arcuate path having the center axis of the pivot fastener 86 as its center. Thus, the lever 84 may be yieldingly retained in three different positions of angular adjustment. Of course, with the lever 84 in the position thereof illustrated in FIG. 3, the trolley frames 56 are closely spaced apart and the lever 84 may be rotated in a clockwise direction from the position thereof illustrated in FIG. 3 of the drawings to move the trolley frames 56 away from each other to vary the spacing therebetween.

Each of the trolley frames 56 has a set of price stamp wheels 106, 108, 110, 112 and 114 mounted on each shaft 46 and the center price stamp wheel 110 of each set is keyed to the corresponding shaft 46 for rotation therewith but is also slidable relative thereto and the wheels 106, 108, 112 and 114 are rotatable and slidable relative to the shafts 46. Each price stamp wheel 106, 108, 110, 112 and 114 includes a diametrically reduced gear wheel portion 116 and each set of wheels carried by the trolley frames 56 are sandwiched between the corresponding spacing sleeves 70 and 72, the wheels 106, 108, 112 and 114 each being freely rotatable on the corresponding shaft 46. In addition, corresponding sets of wheels 106, 108, 110, 112 and 114 are mounted on each of the shafts 46 between each pair of frame members 76 and 78 and each wheel 110 of these additional sets of wheels are also keyed to and slidable relative to the corresponding shafts 46, the wheels 106, 108, 112 and 114 of these additional sets also being freely rotatable and slidable relative to the corresponding shafts 46 and each additional set of wheels disposed between each pair of longitudinal members 76 and 78 being sandwiched between spacing sleeves corresponding to the sleeves 70 and 72 partially telescoped into bores formed through the members 76 and 78 corresponding to the bores 74 and 75.

Excluding the wheels 110 each set of wheels equals four in number, one wheel for each of the corresponding shafts 48, 50, 52 and 54. Each set of shafts 48, 50, 52 and 54 includes a set of spur gears 118, 120, 122 and 124 mounted thereon in each trolley frame 56 and between each pair of frame members 76 and 78 with the gears 118, 120, 122 and 124 received between the corresponding pair of sleeves 66, 68 and keyed to and slidable relative to the shafts 48, 50, 52 and 54, respectively. The gear wheels 118 are meshed with the gear wheels 116 of the corresponding wheels 106, the gear wheels 120 are meshed with the gear wheels 116 of the corresponding stamp wheels 108, the gear wheels 124 are meshed with the gear wheels 116 of the corresponding stamp wheels 112 and the gear wheels 122 are meshed with the gear wheels 116 of the corresponding stamp wheels 114.

A pair of slide guide assemblies referred to in general by the reference numerals 130 and 132 are mounted on the front and rear members 38 and 40 on a path extending between the right hand pair of frame members 76 and 78 in FIG. 3 and each assembly 130 and 132 includes five guide rollers 134. Five elongated adjustment slides 136, 138, 140, 142 and 144 are guidingly supported from the main frame 12 by means of the assemblies 130 and 132 and each of the slides 136, 138, 140, 142 and 144 includes downwardly facing rack gear teeth 146 spaced therealong along the lower marginal edge portion thereof and upwardly opening detent notches 148 spaced along its upper marginal edge portion. A spring retainer assembly referred to in general by the reference numeral 150 is secured across the right hand members 76 and 78 as seen in FIG. 3 and the spring retainer assembly 150 includes contoured spring arms 152 having dished free end portions seatingly receivable in the notches 148 for retaining the adjustment slides 136, 138, 140, 142 and 144 in adjusted longitudinally shifted positions. Further, the slides include upwardly projecting arm portions 154 which are slidably received in corresponding slots 156 formed in the top wall 24 of the cover 14, each of the arms 154 having a finger-engageable knob 160 removably secured to the upper end thereof above the top wall 24 and the top wall 24 having rows of indicia 162 extending along corresponding sides of the slots 156.

The adjustment slides 136, 138, 140, 142 and 144 have the rack gear teeth 146 thereof meshed with the upper peripheral portions of the gear wheels 116 of the stamp wheels 106, 108, 110, 112 and 114, respectively, of those stamp wheels disposed between the right hand pair of members 76 and 78 as viewed in FIG. 3. Accordingly, longitudinal shifting of the adjustment slides 136, 138, 140, 142 and 144 will cause rotation of each set of stamp wheels 106, 108, 110, 112 and 114 disposed between the right hand pair of members 76 and 78 as viewed in FIG. 3. Of course, the center adjustment slide 140 is meshed with the corresponding gear wheels 110 and inasmuch as all of the gear wheels 110 are keyed to the shafts 46, adjustment of the adjustment slide 140 will cause simultaneous adjustment of all of the wheels 110. Further, inasmuch as each gear wheel portion 116 of the stamp wheels 106 has a wheel 118 meshed therewith, adjustment of the adjustment slide 136 will not only cause simultaneous adjustment of the wheels 106 disposed between the right hand members 76 and 78 as viewed in FIG. 3, but also rotational adjustment of the shafts 48 to which the gear wheels 118 are keyed and thus simultaneous adjustment of all of the stamp wheels 106. In addition, the slides 138, 142 and 144 also enjoy a drive connection with all of their respective stamp wheels 108, 112 and 114 in the same manner. Therefore, in order to adjust all corresponding stamp wheels in the twelve sets of stamp wheels it is merely necessary to shift the corresponding adjustment slide and all sixty stamp wheels may be adjusted as desired by slidably adjusting the five adjustment slides 136, 138, 140, 142 and 144.

The lever 84 includes a crank arm 166 having an upwardly projecting knob 168 secured to its free end portion and the knob 168 is swingable through an arcuate slot 170 formed in the top wall 24 of the cover 114. Further, the top wall 24 includes indicia 172, 174 and 176 corresponding to the three predetermined detent retained positions of the lever 84 heretofore described.

Figure 2:
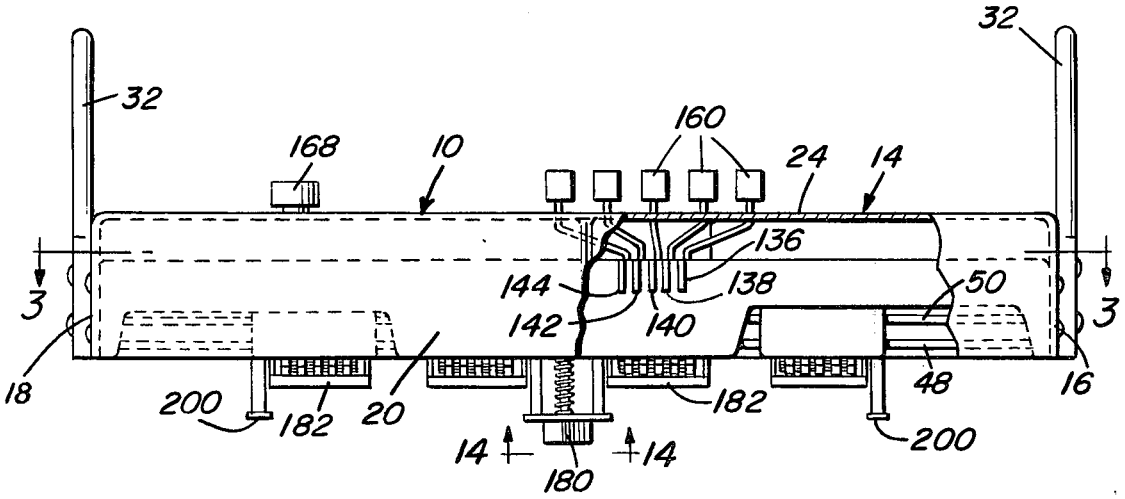
FIG. 2 is a side elevational view of the price marker with a portion of the near side wall of the cover thereof being broken away.
Figure 14:
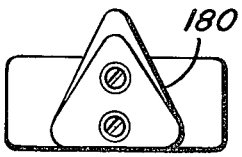
FIG. 14 is a horizontal bottom plan view taken substantially upon the plane indicated by the section line 14—14 of FIG. 2.

With reference now more specifically to FIGS. 2 and 14 of the drawings it may be seen that the central portion of the underside of the frame 12 includes a dependingly supported abutment 180 which is generally triangular in horizontal cross-sectional shape and which is adapted to be downwardly received between adjacent central articles in a layer of articles disposed within a carton having three articles in each of four rows of articles. In this manner, the price marker 10 may be properly centered relative to a plurality of cylindrical articles disposed within a carton and which are to be stamped by means of the stamp assemblies of the price marker, each stamp assembly comprising one set of the stamp wheels 106, 108, 110, 112 and 114.

With attention now invited more specifically to FIGS. 5, 6, 7 and 8 of the drawings, it may be seen that each of the stamp assemblies comprising a set of the stamp wheels 106, 108, 110, 112 and 114 has an inking pad 182 operatively associated therewith and supported by one end of a lever 184 pivotally supported from an adjacent portion of the frame 12 as at 186. Each lever 184 is pivotally supported intermediate its opposite ends and the end thereof remote from the stamp pad or inking pad 182 is pivotally attached as at 190 to one end of a connecting link 192 having its other end pivotally attached as at 194 to the free end of one arm of a bell crank 196 oscillatably supported on the corresponding shaft 52 and including a longitudinally slotted second arm 198. A pressure and contact bar 200 is provided for each pair of bell cranks 198 and is supported at its opposite ends by means of a pair of upstanding guide posts 202 whose upper ends are telescopingly received in upstanding bores 204 formed in adjacent portions of the frame 12. The guide posts 202 are yieldingly urged downwardly by means of compression springs 206 disposed thereabout and having their lower ends engaged with the corresponding pressure bars 200 and their upper ends seated in counterbores 208 formed in the lower ends of the bores 204. In addition, the portions of the frame 12 in which the bores 204 are formed include slots 210 which extend along and open into the bores 204. Intermediate portions of the posts 202 include outwardly projecting pins 212 which are guidingly received in the corresponding slots 210 and are also slidingly received through the slots 214 in the slotted arms 198 of the bell cranks.

Figure 6:
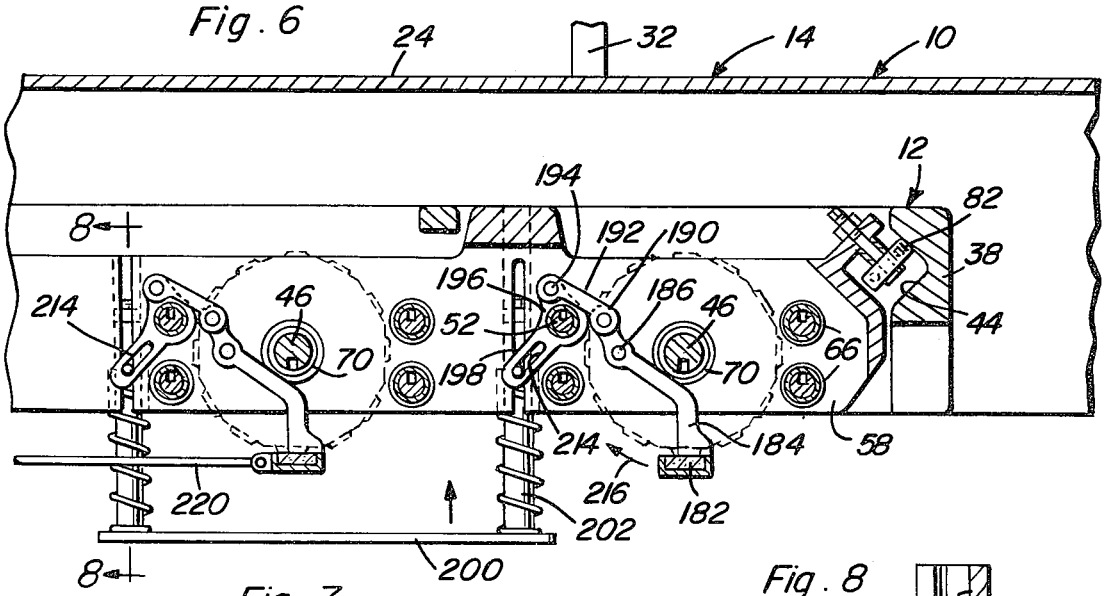
FIG. 6 is a fragmentary enlarged vertical sectional view taken substantially upon the plane indicated by the section line 6—6 of FIG. 3.
Figure 7:
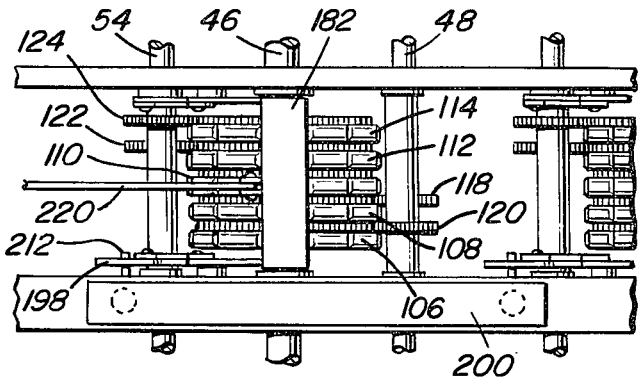
FIG. 7 is a fragmentary bottom plan view of the left hand portion of the assembly illustrated in FIG. 6.
Figure 8:
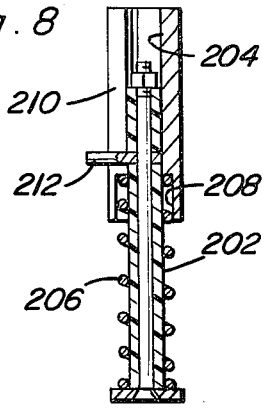
FIG. 8 is an enlarged fragmentary vertical sectional view taken substantially upon the plane indicated by the section line 8—8 of FIG. 6.
Figure 9:
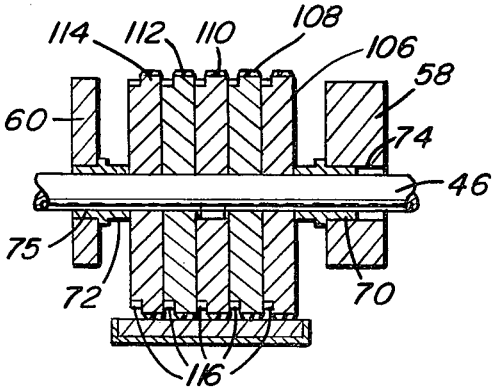
FIG. 9 is a fragmentary vertical sectional view taken substantially upon the plane indicated by the section line 9—9 of FIG. 5.
Figure 10:
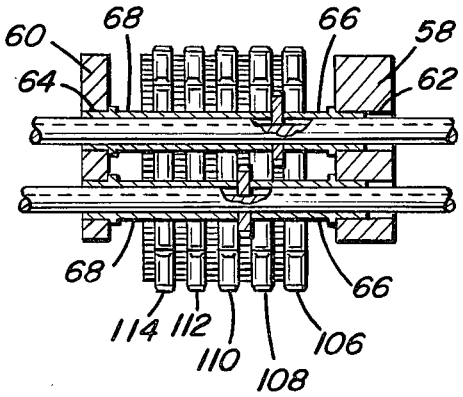
FIG. 10 is a fragmentary vertical sectional view taken substantially upon the plane indicated by the section line 10—10 of FIG. 5.
Figure 11:
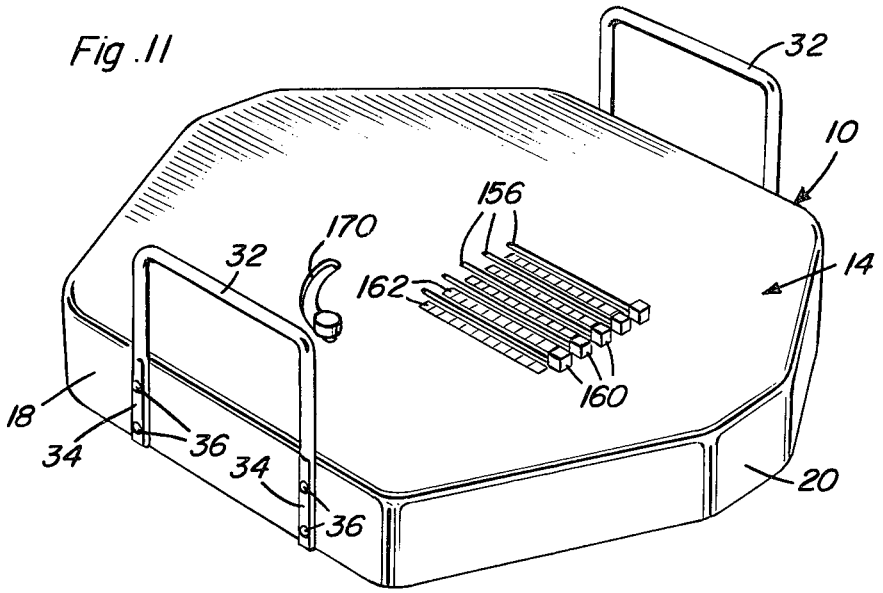
FIG. 11 is a perspective view of the price marker as seen from above and to one side of the front of the marker.
Figure 12:
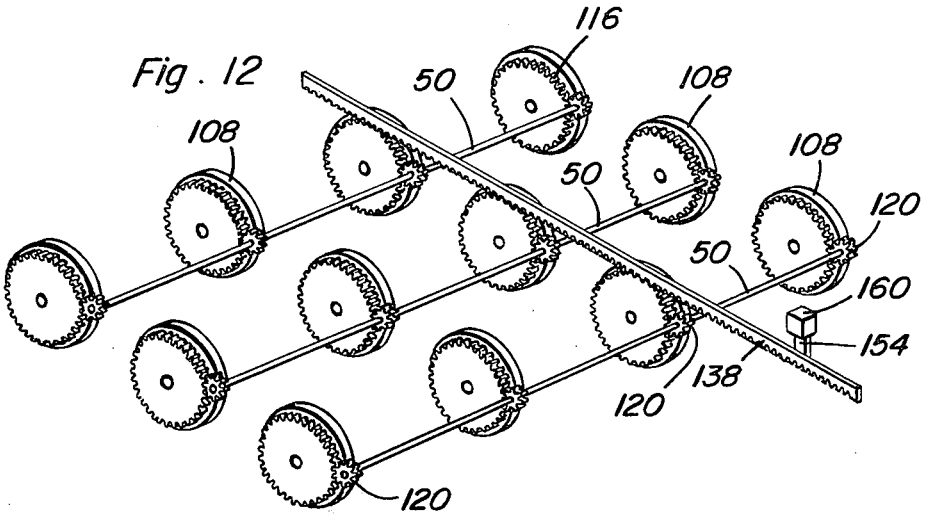
FIG. 12 is a perspective view of one set of corresponding stamp wheels of the twelve stamp assemblies of the marker and with the corresponding stamp wheel adjustment slide operatively associated with the one set of stamp wheels for simultaneous adjustment thereof.

It may thus be seen from FIG. 6 of the drawings that upon upward movement of the pressure bars 200 relative to the frame 12, the bell cranks will be angularly displaced in clockwise directions as viewed in FIG. 6 in order to swing the center and right hand stamp pad ends of the levers 184 in the direction of the arrow 216 in FIG. 6 so as to swing the stamp pads 182 to the side of the associated stamp wheels and above the lower peripheral portions thereof whereby the lower peripheral portions of the stamp wheels will be exposed for price stamping the tops of articles downwardly toward which the price marker 10 is lowered, the left hand stamp pad 182 (FIGS. 4 and 5) is actuated by a connecting rod 220 whose opposite ends are pivotally connected to the center portions of the adjacent edges of the left hand and center pads 182. Of course, each time the price marker 10 is lowered downwardly to simultaneously price mark all of the articles within a case of articles, the lower peripheral portions of all of the sixty stamp wheels of the price marker will be inked by movement of the inking pads 182 into the positions thereof illustrated in FIG. 6 as the price marker 110 is lifted upwardly from the articles just price marked.

Figure 13:
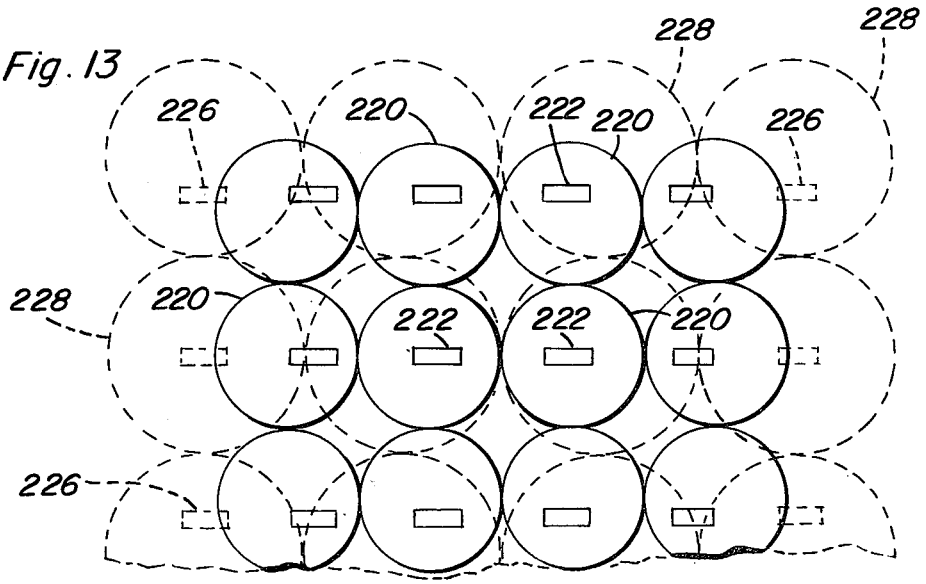
FIG. 13 is a fragmentary schematic top plan view of twelve articles as they may be packaged within a carton and with the various locations of the twelve stamp assemblies of the marker in closely spaced relation relative to each other indicated in solid lines for registry with the articles which are also illustrated in solid lines, the relative locations of larger articles and the twelve stamp assemblies when in the relatively expanded positions being illustrated in phantom lines.

With attention now invited more specifically to FIG. 13 of the drawings, the circles 220 illustrated in solid lines indicate the approximate positions of twelve small articles disposed within a carton of articles to be stamped and the rectangular boxes 222 illustrated in solid lines indicate the relative positions of the twelve sets of stamp wheels 106, 108, 110, 112 and 114 when the control lever 84 is in the position thereof illustrated in FIG. 3. However, when the control lever 84 is angularly displaced approximately 90 degrees in a clockwise direction from the position thereof illustrated in FIG. 3 of the drawings the trolley frames 56 will be shifted away from each other and away from the central stationary six sets of stamp wheels. Thus, the stamp assemblies carried by the trolley frames 56 will be disposed in the rectangular phantom line positions designated by the reference numerals 226 whereby twelve large articles represented by the circular phantom lines 228 may be simultaneously price stamped by the price marker 10.

Thus, the price marker 10 may simultaneously stamp all twelve articles in a layer of articles contained within a carton even though the horizontal cross-sectional size of the articles in different cartons and thus the cartons themselves may differ in size. Further, all sixty stamp wheels 106, 108, 110, 112 and 114 may be adjusted by merely longitudinally slidably adjusting the five adjustment slides 136, 138, 140, 142 and 144.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is new is as follows:

1. A price marker for price stamping all containers in a case or carton at one time, said marker including a frame, at least two sets of price stamp assemblies supported from said frame, each set of assemblies including at least three assemblies spaced apart in a horizontal row and said sets of assemblies being supported from said frame with the rows of assemblies disposed in generally parallel horizontally spaced apart side-by-side relation, each price stamp assembly including a plurality of price stamp wheels supported for independent angular adjustable positioning about an axis extending transversely of said rows and in a plane containing said rows for bringing selected peripheral portions thereof into a lower price stamping position, at least one set of said assemblies being stationarily supported from said frame and at least one set of said assemblies being supported from said frame for adjustable shifting relative to said frame in said plane for varying the spacing between said sets of assemblies, actuator means shiftably supported from said frame and operatively connected to said adjustably shiftable set of assemblies for simultaneously shifting all of the assemblies of said shiftable set relative to said frame, each wheel of each assembly corresponding to a predetermined wheel of each other assembly, and price change adjustment means shiftably supported from said frame and including a shiftable operator associated with each group of corresponding stamp wheels of said sets of assemblies, and connecting drive means operatively connected between each operator and the associated group of stamp wheels of said assemblies, whereby adjustment of each operator will simultaneously adjustably shift the associated stamp wheels of all stamp assemblies, said connecting drive means including means operative to adjust the associated stamp wheels of the stationary assemblies as well as the adjustable sets of assemblies throughout the range of adjustment of said adjustable sets of assemblies relative to said frame

2. The combination of claim 1 wherein said marker includes four sets of price stamp assemblies arranged in four side-by-side rows, the two center rows of assemblies being stationarily supported from said frame and the two outer rows of assemblies being each stationarily supported from carriage means, the carriage means for each outer row of assemblies being supported from said frame for adjustable shifting relative to said frame in paths disposed at substantially right angles relative to said rows of assemblies.

3. The combination of claim 1 wherein the lower peripheral portions of said stamp wheels are exposed from below and adapted for downward displacement into engagement with articles to be price marked.

4. The combination of claim 3 including a plurality of ink pad means including portions thereof for each stamp assembly and supported from said frame for movement between active positions underlying and contacting said stamp wheel lower portions and inactive positions retracted upwardly to positions disposed along side said stamp assemblies and above said stamp wheel lower portions, said ink pad means each including a pad means actuator dependingly supported from said frame for vertical shifting relative thereto between lowered positions disposed below said stamp wheel lower portions and raised positions spaced above said stamp wheel lower portions, and connecting means connecting said actuators to said ink pad portions for shifting the latter between said active and inactive positions in response to movement of said actuators between said lowered and raised positions respectively.

5. A device for simultaneously marking a plurality of articles arranged in horizontally spaced relation, said device including a support member, at least three horizontally spaced side-by-side horizontal rows of longitudinally spaced marking assemblies, means mounting two of said rows of marking assemblies on said support member for back and forth shifting of said two rows relative to said support member in a direction transverse to said rows and in a plane containing said rows, actuator means shiftably supported from said support member and operatively connected to said shiftable rows of marking assemblies for simultaneously shifting the shiftable rows of assemblies to vary the spacing between said shiftable rows and the third row of marking assemblies, said marking assemblies including corresponding sets of side by side marking wheels with the marking wheels of each set supported for independent angular adjustable positioning about an axis extending transversely of said rows and in said plane, for bringing selected peripheral portions thereof into predetermined lower marking positions, each wheel of each assembly corresponding to a predetermined wheel of each other assembly, adjustment means supported from said support member for shifting relative thereto, said adjustment means including a shiftable operator for each group of corresponding marking wheels of said sets of marking wheels and connecting drive means operatively connected between each operator and all of the marking wheels of the corresponding group of marking wheels for simultaneous adjustable positioning of the corresponding group of marking wheels in response to shifting of the associated operator, said connecting drive means including means operative to adjust the corresponding stamp wheels throughout the range of adjustment of said adjustable rows of marking assemblies relative to said support member.

* * * * *